United States Patent [19]

Langen

[11] Patent Number: 5,045,097

[45] Date of Patent: Sep. 3, 1991

[54] SOOT FILTER FOR DIESEL-POWERED VEHICLES

[75] Inventor: Herbert Langen, Altbach, Fed. Rep. of Germany

[73] Assignee: J. Eberspächer, Esslingen, Fed. Rep. of Germany

[21] Appl. No.: 429,804

[22] Filed: Oct. 30, 1989

[30] Foreign Application Priority Data

Oct. 31, 1988 [DE] Fed. Rep. of Germany ..... 3837073

[51] Int. Cl.[5] ..... F01N 3/02

[52] U.S. Cl. ..... 55/282; 55/523; 55/DIG. 30; 60/311

[58] Field of Search ..... 55/282, 466, 523, DIG. 30; 60/311

[56] References Cited

U.S. PATENT DOCUMENTS

| | | | |
|---|---|---|---|
| 3,815,337 | 6/1974 | Lenane | 60/311 |
| 3,918,936 | 11/1975 | Holloway et al. | 60/311 |
| 4,281,512 | 8/1981 | Mills | 55/466 |
| 4,373,330 | 2/1983 | Stark | 55/466 |
| 4,404,798 | 9/1983 | Takagi et al. | 55/DIG. 30 |
| 4,730,455 | 3/1988 | Pischinger et al. | 55/466 |
| 4,848,083 | 7/1989 | Goerlich | 55/466 |
| 4,866,932 | 9/1986 | Morita et al. | 55/523 |

FOREIGN PATENT DOCUMENTS

| | | | |
|---|---|---|---|
| 55-19934 | 2/1980 | Japan | 60/311 |
| 56-92318 | 7/1981 | Japan | 60/311 |

*Primary Examiner*—Jay H. Woo
*Assistant Examiner*—C. Scott Bushey
*Attorney, Agent, or Firm*—McGlew & Tuttle

[57] ABSTRACT

A soot filter for diesel-powered vehicles has two diesel particle filters which are connected to a preliminary muffler via separate ducts, which open radially into a filter prechamber. The exhaust gases can be sent through one of the diesel particle filters or the other by a damper control device, with the dampers being arranged far away from the filters, in the vicinity of the preliminary muffler. Thus, the dampers are located at a fairly great distance from the burner, which is arranged on the front side of the diesel particle filter, and which is designed such that it produces an approximately disk-shaped flame that is directed toward the front side of the diesel particle filter.

7 Claims, 1 Drawing Sheet

SOOT FILTER FOR DIESEL-POWERED VEHICLES

FIELD OF THE INVENTION

The present invention pertains to a soot filter for diesel-powered vehicles comprising a filter regenerator.

BACKGROUND OF THE INVENTION

Reduction of the amount of soot particles emitted by diesel engines (diesel particles) during operation can make the use of diesel engines more attractive because of the considerably reduced environmental pollution. The use of soot filters in the exhaust system of diesel engines can lead to the retention of a considerable percentage of the soot particles present in the exhaust gas.

However, the fact that filters that appear to be suitable, especially filters consisting of ceramic threads or ceramic fiber packings, become clogged relatively rapidly, thus losing their filter effect, is problematic.

To regenerate such filters, it has been proposed that the soot particles located within the filter material be burned off with a burner. It has also been proposed that an oxidizing agent be sprayed into the filter in order to lower the ignition temperature of the soot.

Soot filters must be regenerated at certain intervals (determined in terms of hours of operation or the pressure rise of the exhaust gas flowing through). Since the regeneration process takes some time and it cannot be assumed that the engine would be stopped during this period, two diesel particle filters can be arranged in parallel, one of which is always connected in the path of the exhaust gas, while the other is being regenerated and is awaiting use after completion of the regeneration. In an attempt to keep the fuel consumption of an engine as low as possible, the output of the burners during the regeneration of diesel particle filters should also be kept low.

SUMMARY AND OBJECT OF THE INVENTION

It is an object of the present invention to provide a soot filter of the class described in the introduction, which permits regeneration with low energy consumption and also guarantees reliable operation.

According to the present invention two separate diesel particle filters are provided connected to a preliminary muffler via separate ducts. The ducts open radially, tangentially or somewhere between the two angles into a prechamber of the respective diesel particle filter, and a burner is associated with the front end of the prechamber of each diesel particle filter.

Due to the fact that the ducts located between the preliminary muffler and the respective diesel particle filters open radially tangentially or between (both limiting cases are possible), it is possible to arrange the respective burner on the front side of the prechamber of the respective diesel particle filter. Since the largest amount of soot particles is collected in the vicinity of the entry of the exhaust gases, regeneration by means of a burner arranged on the front side is found to be particularly efficient, since the flame of the burner or the hot air has the highest temperature where most of the soot particles are located. The arrangement according to the present invention is found to be particularly favorable in terms of the energy to be consumed, i.e., the amount of fuel needed for one regeneration process.

Experiments have demonstrated a serious problem caused by the fact that the function of the change-over dampers located in the ducts between the preliminary muffler and the diesel particle filters is impaired by the considerable heat of the burner. Due to the fact that the exhaust ducts open into the filters radially and to the resulting possibility for arranging the burners on the filters or the prechambers of the filters, it is possible to arrange the change-over dampers at a relatively great distance from the burners, preferably at the end of the preliminary muffler. The temperature of the gases heated by the burner actually in operation is no longer too high at this point, so that the corresponding change-over damper is not heated excessively and its ability to function is not impaired.

It was also found that the change-over dampers can be protected from elevated gas temperatures particularly well if the distance between each of the change-over dampers and the associated end of entry of the duct into the filter prechamber is greater than the diameter of the duct, because the dispersion of the gases heated by the burner depends very strongly on the cross section area of the duct extending from the preliminary muffler. Consequently, if the changeover damper is at a spaced location from the entry end at the prechamber of the filter, and this distance is preferably equal to the diameter of the canal, only a relatively small amount of heated gas will reach the change-over damper, so that the temperature of said change-over damper cannot rise to very high values.

Arrangement of the burners on the front side of the respective diesel particle filter or of the filter prechamber leads to the above-described advantages. Using a burner producing a relatively flat and broad flame, i.e., essentially a disk-shaped or platter-shaped flame, was found to be particularly advantageous for the regeneration process.

The applicant has previously proposed the design of a burner (that is suitable for use for vehicle heaters as well as for cooking purposes) (West German Offenlegungsschrift No. 34,10,716) in which a shield is arranged between a burner chamber and a combustion space, and the conical opening of the shield forms a disk-shaped flame in the combustion space. A burner of such a design is preferably used in the present invention. Using such a burner, a disk-shaped flame, which touches the filter packing within the diesel particle filter on its front side over its entire surface area, is obtained in the filter prechamber. This contributes to the rapid and intensive regeneration of the filter.

A further object of the invention is to provide a soot filter arrangement for diesel powered vehicles which is simple in design, rugged in construction and economical to maintain and manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENT

Figure 2:
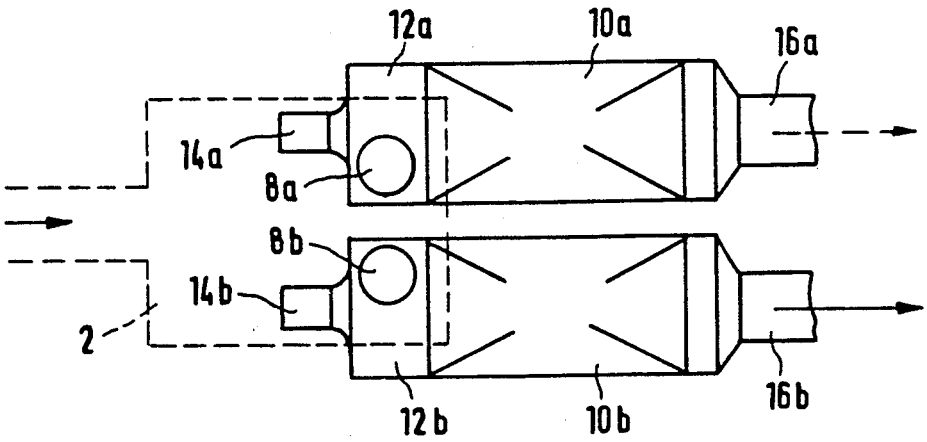

The exhaust gas stream of a diesel engine is indicated by an arrow in the top left part of FIG. 2. The present invention can be used particularly advantageously for high-performance diesel engines, especially those of utility vehicles.

The exhaust gases of the diesel engine, carrying soot particles (diesel particles), enter a preliminary muffler 2 from the exhaust manifold via one or several exhaust pipes, and two ducts 4*a* (not shown) and 4*b* of circular cross section. The ducts 4*a* and 4*b* extend approximately vertically downward and are located at the end of the preliminary muffler. There is a change-over damper that can be swiveled around a horizontal axis in each duct. One of the change-over dampers, 6*b*, is shown schematically in FIG. 1. In the position shown, the change-over damper 6*b* shuts off the duct 4*b*, so that the exhaust gases enter a corresponding diesel particle filter 10*a* from the preliminary muffler 2 via canal 4*a* (not shown), flowing past the change-over damper 6*a*, (not shown) which is in the vertical position. FIG. 2 shows two diesel particle filters 10*a* and 10*b* arranged horizontally next to each other. Each diesel particle filter has a prechamber 12*a* and 12*b*, respectively, into which the respective canals 4*a* and 4*b* open via inlet openings 8*a* and 8*b*, respectively, at a defined angle. In the embodiment shown, the entrance of the gas is between the radial and tangential angles of the filter either.

The front side of each prechamber 12*a* and 12*b* is associated with a diesel fuel-fired burner 14*a* and 14*b*, respectively. Each of the burners has the design described in the aforementioned West German Offenlegungsschrift No. 34,10,716. The burners 14*a* and 14*b* produce an approximately disk-shaped flame within the respective prechamber 12*a* and 12*b*, so that the filter packing in the respective diesel particle filter 10*a* and 10*b* is exposed to the flame.

The two change-over dampers in the two ducts 4*a* and 4*b* are closed and opened alternatingly by a damper control device 18, and change-over is controlled, e.g., by a service hour meter or a pressure measuring device. The service hour meter can be adjusted such that after a certain number of operating hours, it will generate a signal, on the basis of which the damper control device 18 will shut one of the ducts 4*a* and 4*b* and open the other. If a pressure measuring device is used, the exhaust gas back pressure is measured, e.g., at the inlet of the respective diesel particle filter 10*a* or 10*b*, because this exhaust gas back pressure is an indicator of the free flow cross section of the filter. A filter that is clogged relatively generates a considerably higher exhaust gas back pressure than a fresh filter.

While, e.g., duct 4*b* is shut off by the change-over damper 6*b*, the exhaust gases enter an exhaust pipe 16*a* through the other duct 4*a*, prechamber 12*a*,and diesel particle filter 10*a* (the two diesel particle filters 10*a* and 10*b* also serve as mufflers). At the same time, filter regeneration can be performed in the diesel particle filter 10*b* through which no exhaust gas flows. To do so, burner 14*b* is turned on by a control unit, that is of no particular interest here, so that the soot particles accumulated in the filter material of filter 10*b* are burned off by the disk-shaped flame produced by this burner. The harmless residues formed in this process are discharged through exhaust pipe 16*b*.

Figure 1:
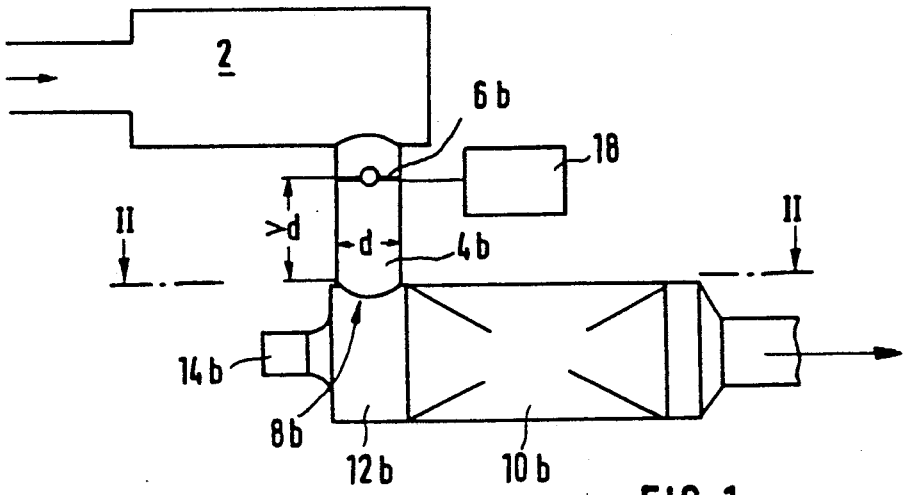
FIG. 1 shows a schematic side view of part of an exhaust system with a soot filter; and, FIG. 2 is a top view of the system viewed in the direction of line II—II in FIG. 1.

As is indicated in FIG. 1, the distance between inlet opening 8*b* on the prechamber 12*b* of filter 10*b* and the change-over damper 6*b*, which is in the closed position, is greater than the diameter d of the corresponding duct 4*b*. It is thus achieved that when the burner 14*b* is on, the change-over damper is heated only slightly.

Based on the special design and arrangement of the burner (with the corresponding filter arranged on the front side), uniform heating of the inlet cross section of the filter material is achieved.

While specific embodiments of the invention have been shown and described in detail to illustrate the application of the principles of the invention, it will be understood that the invention may be embodied otherwise without departing from such principles.

What is claimed is:

1. A soot filter regenerator arrangement for diesel-powered vehicles, comprising: a first diesel particle filter including a pre-chamber; a second diesel particle filter including a pre-chamber; a preliminary muffler connected to an exhaust stream of the diesel-powered vehicle; a first duct connected from said preliminary muffler to said pre-chamber of said first particle filter, said first duct connecting into said first diesel particle filter pre-chamber between one of a radial and tangential direction with respect to said first diesel particle filter pre-chamber; a second duct connected from said preliminary muffler to said pre-chamber of said second particle filter, said second duct connecting into said second diesel particle filter pre-chamber between one of a radial and tangential direction with respect to said second diesel particle filter pre-chamber; a first burner connected to said pre-chamber of said first diesel particle filter; a second burner connected to said pre-chamber of said second diesel particle filter; and, said first and second burners producing an approximately disc-shaped flame directly interacting with soot lighting surfaces of the soot filter.

2. A soot filter and regenerator arrangement according to claim 1, further comprising: change-over damper means connected to each of said first and second ducts for selectively closing one of said first and second ducts and control means connected to said change-over damper means, for controlling said selective closing at one of said ducts.

3. A soot filter according to claim 2, wherein said change over damper means includes a first damper positioned within said first duct and a second damper positioned within said second duct, each of said dampers being spaced from a corresponding inlet to said filter pre-chamber by a distance which is greater than the diameter of said duct.

4. A soot filter regenerator arrangement according to claim 1, wherein each of said first and second burners use liquid fuel for generating said approximately disk-shaped flame.

5. A soot filter regenerator arrangement for diesel-powered vehicles, comprising: a first diesel particle filter including a pre-chamber; a second diesel particle filter including a pre-chamber; a preliminary muffler connected to an exhaust stream of the diesel-powered vehicle; a first duct connected from said preliminary muffler to said pre-chamber of said first particle filter, said first duct connecting into said first diesel particle filter pre-chamber between one of a radial and tangential direction with respect to said first diesel particle filter pre-chamber; a second duct connected from said preliminary muffler to said pre-chamber of said second particle filter, said second duct connecting into said second diesel particle filter pre-chamber between one of a radial and tangential direction with respect to said second diesel particle filter pre-chamber; a first burner connected to said pre-chamber of said first diesel particle filter; and, a second burner connected to said pre-chamber of said second diesel particle filter; change-over damper means connected to each of said first and second ducts between the preliminary muffler and the corresponding first and second diesel particle filters, said change-over damper means for selectively closing one of said first and second ducts; and control means connected to said change-over damper means, for controlling said selective closing at one of said ducts, each of said first and second burners including means for generating a substantially disk-shaped flame and for directing said flame toward a front end of a corresponding one of said first and second diesel particle filters.

6. A soot filter regenerator arrangement according to claim 5, wherein said change-over damper means is positioned adjacent said preliminary muffler at a location spaced form said pre-chambers of each of said first and second diesel particle filters.

7. A soot filter regenerator arrangement according to claim 5, wherein each of said first and second diesel particle filters are positioned below said preliminary muffler, said first and second ducts extending downwardly from said preliminary muffler.

* * * * *